US005152527A

United States Patent [19]

Mather et al.

[11] Patent Number: 5,152,527

[45] Date of Patent: Oct. 6, 1992

[54] SPORTING EQUIPMENT

[75] Inventors: James Mather; Dennis Vardy; Brian J. Waites, all of Nottingham, Great Britain

[73] Assignee: Sports Technology & Research Limited, Nottingham, Great Britain

[21] Appl. No.: 635,356

[22] Filed: Dec. 28, 1990

Related U.S. Application Data

[63] Continuation-in-part of Ser. No. 460,157, Mar. 19, 1990, abandoned.

[30] Foreign Application Priority Data

Jul. 29, 1987 [GB] United Kingdom ..... 8717964
Jul. 29, 1988 [GB] United Kingdom PCT/GB88/00629

[51] Int. Cl.[5] ..... A63B 53/00

[52] U.S. Cl. ..... 273/77 A; 273/81 A; 73/65

[58] Field of Search ..... 273/81 R, 81 A, 77 R, 273/77 A, 67 DB; 73/65

[56] References Cited

U.S. PATENT DOCUMENTS

| | | | |
|---|---|---|---|
| 1,210,182 | 12/1916 | Lynch | 273/81 A |
| 1,516,786 | 11/1924 | Prentiss | 273/77 A |
| 1,594,801 | 8/1926 | Stackpole | 273/77 A |
| 1,658,447 | 2/1928 | Lantz | 273/81 A |
| 1,953,916 | 4/1934 | Adams | 73/65 |
| 3,075,768 | 1/1963 | Karns | 273/81 A |
| 3,473,370 | 10/1969 | Marciniak | 273/77 A |
| 3,698,239 | 10/1972 | Everett | 73/65 |
| 3,703,824 | 11/1972 | Osborne et al. | 73/65 |
| 3,984,103 | 10/1976 | Nix | 273/77 A |
| 4,058,312 | 11/1977 | Stuff et al. | 273/77 A |
| 4,128,242 | 12/1978 | Elkins | 273/77 A |
| 4,261,566 | 4/1981 | MacDougall | 273/77 A |
| 4,280,700 | 7/1981 | Plagenhoef | 273/81 A X |
| 4,415,156 | 11/1983 | Jorgensen | 273/77 A |
| 4,461,479 | 7/1984 | Mitchell | 273/77 A X |
| 4,600,195 | 7/1986 | Hunter | 273/81 A |
| 4,674,746 | 6/1987 | Benoit | 273/81 A |
| 4,887,815 | 12/1989 | Hughes et al. | 273/77 A |

FOREIGN PATENT DOCUMENTS

| | | | |
|---|---|---|---|
| 8301578 | 5/1983 | European Pat. Off. | 273/77 R |
| 0227347 | 7/1987 | European Pat. Off. | 273/81 A |
| 8900875 | 2/1989 | European Pat. Off. | 273/81 A |

*Primary Examiner*—Paul E. Shapiro
*Assistant Examiner*—Sebastiano Passaniti
*Attorney, Agent, or Firm*—Bachman & LaPointe

[57] ABSTRACT

The swing of a golf club is changed by adding an additional weight, the center of gravity of the additional weight being at or below the center of gravity of the hand position on the gripping region of the club to provide a positive lever action for the club in the first cocked movement of the swing substantially the same moment of inertia in the first phase of the downswing wherein the golfer's hands are in the cocked position as conventional clubs and to provide a reduced moment of inertia for the club in the second uncocked movement of the swing between the uncocking of the golfer's hands and the striking of a golf ball.

21 Claims, 10 Drawing Sheets

Standard 6 Iron

| Added Weight (gms) | distance below hands (mm) 0 | 50 | 75 | 100 |
|---|---|---|---|---|
| 50 | 3.7 | 3.7 | 3.6 | 3.5 |
| 75 | 5.5 | 5.4 | 5.3 | 5.1 |
| 100 | 7.3 | 7.1 | 6.9 | 6.7 |
| 125 | 8.9 | 8.7 | 8.5 | 8.2 |
| 150 | 10.5 | 10.3 | 10 | 9.7 |

Lightweight 6 Iron

| Added Weight (gms) | distance below hands (mm) 0 | 50 | 75 | 100 |
|---|---|---|---|---|
| 50 | 4.1 | 4.1 | 4 | 3.8 |
| 75 | 6.1 | 6 | 5.8 | 5.6 |
| 100 | 7.9 | 7.8 | 7.6 | 7.3 |
| 125 | 9.8 | 9.6 | 9.3 | 8.9 |
| 150 | 11.6 | 11.3 | 10.9 | 10.5 |

Standard Driver

| Added Weight (gms) | distance below hands (mm) 0 | 50 | 75 | 100 |
|---|---|---|---|---|
| 50 | 4 | 3.9 | 3.8 | 3.7 |
| 75 | 5.8 | 5.7 | 5.6 | 5.4 |
| 100 | 7.7 | 7.5 | 7.3 | 7.1 |
| 125 | 9.4 | 9.2 | 9 | 8.7 |
| 150 | 11.1 | 10.8 | 10.6 | 10.3 |

Lightweight Driver

| Added Weight (gms) | distance below hands (mm) 0 | 50 | 75 | 100 |
|---|---|---|---|---|
| 50 | 4.2 | 4.2 | 4.2 | 3.9 |
| 75 | 6.2 | 6.1 | 6 | 5.8 |
| 100 | 8.1 | 8 | 7.8 | 7.5 |
| 125 | 10 | 9.9 | 9.6 | 9.2 |
| 150 | 11.8 | 11.6 | 11.2 | 10.8 |

*FIG—1* Percentage change to the torque ratios

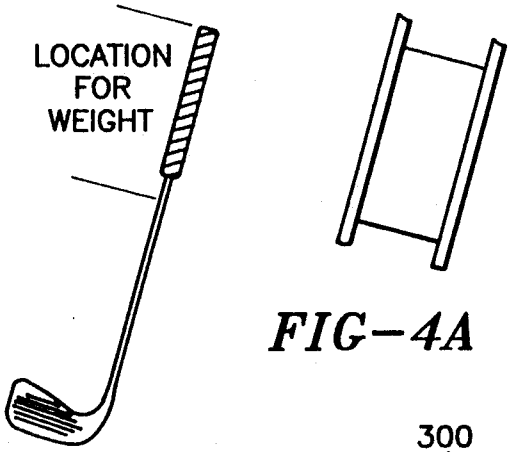
FIG-3
FIG-4A
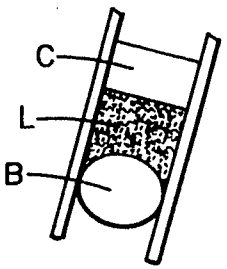
FIG-4B
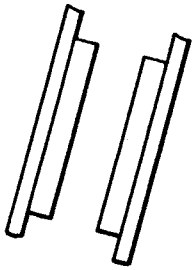
FIG-4C
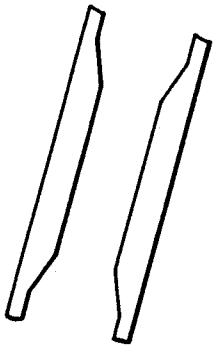
FIG-4D
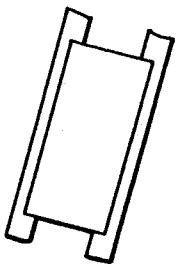
FIG-4E
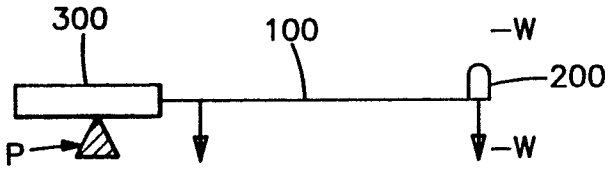
FIG-5
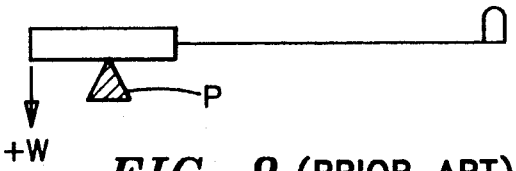
FIG-8 (PRIOR ART)
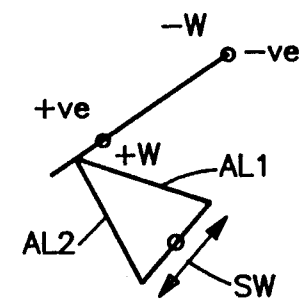
FIG-6
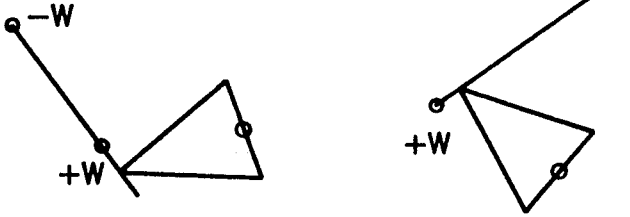
FIG-7
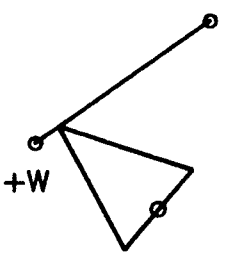
FIG-9 (PRIOR ART)
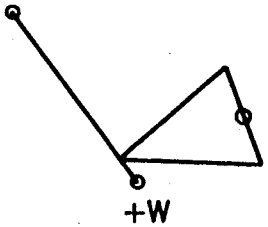
FIG-10 (PRIOR ART)

| club | core wt | core c of g | butt trim | tip trim |
|---|---|---|---|---|
| driver | 118 | 6 | 1 | 3 |
| 3 wood | 116 | 6 | 2 | 3 |
| 5 wood | 113 | 6 | 3 | 3 |
| 1 iron | 101 | 8 | 0 | 4 |
| 2 iron | 99 | 8 | .5 | 4 |
| 3 iron | 96 | 8 | 1 | 4 |
| 4 iron | 93 | 8 | 1.5 | 4 |
| 5 iron | 90 | 8 | 2 | 4 |
| 6 iron | 86 | 8 | 2.5 | 4 |
| 7 iron | 82 | 8 | 3 | 4 |
| 8 iron | 78 | 8 | 3.5 | 4 |
| 9 iron | 74 | 8 | 4 | 4 |
| wedge | 70 | 8 | 4.5 | 4 |
| sand iron | 74 | 8 | 4.5 | 4 |

The sand iron is the same length as the wedge.

*FIG-25*

| club | core wt | core c of g | butt trim | tip trim |
|---|---|---|---|---|
| driver | 105 | 6 | 1 | 3 |
| 3 wood | 103 | 6 | 2 | 3 |
| 5 wood | 100 | 6 | 3 | 3 |
| 1 iron | 92 | 8 | 0 | 4 |
| 2 iron | 90 | 8 | .5 | 4 |
| 3 iron | 87 | 8 | 1 | 4 |
| 4 iron | 85 | 8 | 1.5 | 4 |
| 5 iron | 82 | 8 | 2 | 4 |
| 6 iron | 79 | 8 | 2.5 | 4 |
| 7 iron | 75 | 8 | 3 | 4 |
| 8 iron | 72 | 8 | 3.5 | 4 |
| 9 iron | 68 | 8 | 4 | 4 |
| wedge | 64 | 8 | 4.5 | 4 |
| sand iron | 68 | 8 | 4.5 | 4 |

The sand iron is the same length as the wedge

*FIG-26*

SPORTING EQUIPMENT

CROSS REFERENCE TO RELATED APPLICATION

This application is a continuation-in-part of U.S. patent application Ser. No. 460,157 filed Mar. 19, 1990 abandoned.

BACKGROUND OF THE INVENTION

The present invention relates to sporting equipment and more particularly to improvements in or relating to the design of golf clubs, hereinafter referred to as clubs.

With known designs of clubs the weight, for any given weight of club, tends to be concentrated at the head of the club and whilst for the professional player this weight is controllable during striking of the ball for the amateur player the ball is often wrongly struck.

The invention provides a golf club which is much easier to use than previous known golf clubs by reducing the moment of inertia about the wrist-cock axis relative to a prior art golf club to thereby enable better control to be achieved in the second critical part of the golfer's swing.

It is an object of the present invention to provide a club with a weight distribution which enables the amateur player to strike the ball with greater accuracy and greater consistency.

SUMMARY OF THE INVENTION

The foregoing object is achieved by way of the present invention wherein a set of golf clubs wherein each of the golf clubs in the set are of a different length are provided with the weight specifically located in the shaft of each of the golf clubs of the set such that during a downward swing of any of the clubs of the set by a golfer the moment ($M_1$) and a second moment of inertia ($M_2$) about a wrist-cock axis are controlled so as to enable the amateur player to strike the ball with greater accuracy and greater consistency. In accordance with the present invention the shaft of each of the golf clubs is provided with a distinct grip disposed on the shaft which defines a normal gripping area for gripping the club by the golfer. The gripping area includes a normal central position located approximately four inches below the butt end of the shaft wherein the golfer's hands are normally located. In accordance with the present invention, an additional weight is provided on the shaft adjacent to the gripping area for altering the balance of the club so as to control the moment ($M_1$) and second moment of inertia ($M_2$) as aforesaid. The additional weight is positioned at a predetermined location adjacent the gripping area and the mass of the additional weight is calculated in accordance with the weight of the head of the club to achieve an inertia ratio of the club of greater than 2.0. Inertia ratio is defined by the following equation:

$$(I+MR^2)/I$$

wherein I is the moment of inertia, M is the total weight of the golf club, and R is the effective length of the golfer's arm. In accordance with the particular feature of the present invention the center of gravity of the additional weight is located about between 0 to 4 inches below the normal central position of the golfer's hand on the gripping area. By locating the additional weight as aforesaid the moment ($M_1$) about the wrist-cock axis during movement of the golf club during the downswing of the golf club is less than $24.5\times10^3$ GMCM and the moment of inertia ($M_2$) about the wrist-cock axis during movement of the club during the downswing of the golf club between the uncocking of the golfer's wrists and striking of the ball is less than $1.9\times10^6$ GMCMS$^2$. By controlling the moment ($M_a$) and moment of inertia ($M_2$) as aforesaid the amateur player is able to strike the ball with greater accuracy and greater consistency.

Preferably in a further embodiment the second moment about the wrist-cock axis is less than $1.8\times10^6$ gm cm$^2$ and the first moment is less than $23.5\times10^3$ gm cm.

In a still further preferred embodiment, the moment about the wrist-cock axis is less than $1.7\times10^6$ gm cm$^2$ and the first moment is less than $23.0\times10^3$ gm cm.

In accordance with the present invention, a method is provided for designing a set of golf clubs having the inertia ratio, moment ($M_1$) and moment of inertia ($M_2$) as described above. In accordance with the method of the present invention the weights of the head, shaft and grip of each golf club in the set of golf clubs are determined in weight of the head of the golf club is reduced and the additional weight is applied to the shaft based on the weights of the head, shaft and grip of the golf club so as to locate the additional weight in order to obtain the desired characteristics of the golf club of the present invention as described hereinabove.

BRIEF DESCRIPTION OF THE DRAWINGS

Embodiments of the present invention will now be described, with reference to the accompanying drawings in which:

FIG. 1 shows a set of tables illustrating the variation of the ratio of torque applied by the player to the torque actually applied to the club;

FIG. 3 illustrates the range of positions of the added weight on the golf club;

FIGS. 4*a* to 4*e* illustrate various designs of weight for the golf club of FIG. 3;

FIG. 5 shows a diagram showing the leverage principle of the club according to the present invention;

FIG. 6 shows a diagram illustrating the forces produced by a golf club according to the present invention in the upper or first part of the golf swing;

FIG. 7 shows a diagram illustrating the forces produced by the golf club of FIG. 6 during the lower or second part of a golf swing;

FIG. 8 shows a diagram showing the leverage principle of a known prior art golf club;

FIG. 9 shows a diagram illustrating the forces produced by the golf club of FIG. 8 in the upper or first part of a golf swing;

FIG. 10 shows a diagram illustrating the forces produced by the golf club of FIG. 8 in the lower or second part of the golf swing;

FIG. 25 shows a table illustrating additional (core) weights, their positions of centre of gravity and trimming details for the clubs illustrated in FIG. 22 and FIG. 26 shows a table illustrating additional (core) weights, their positions of centre of gravity and trimming details for the clubs illustrated in FIG. 23.

DETAILED DESCRIPTION

Figure 2:
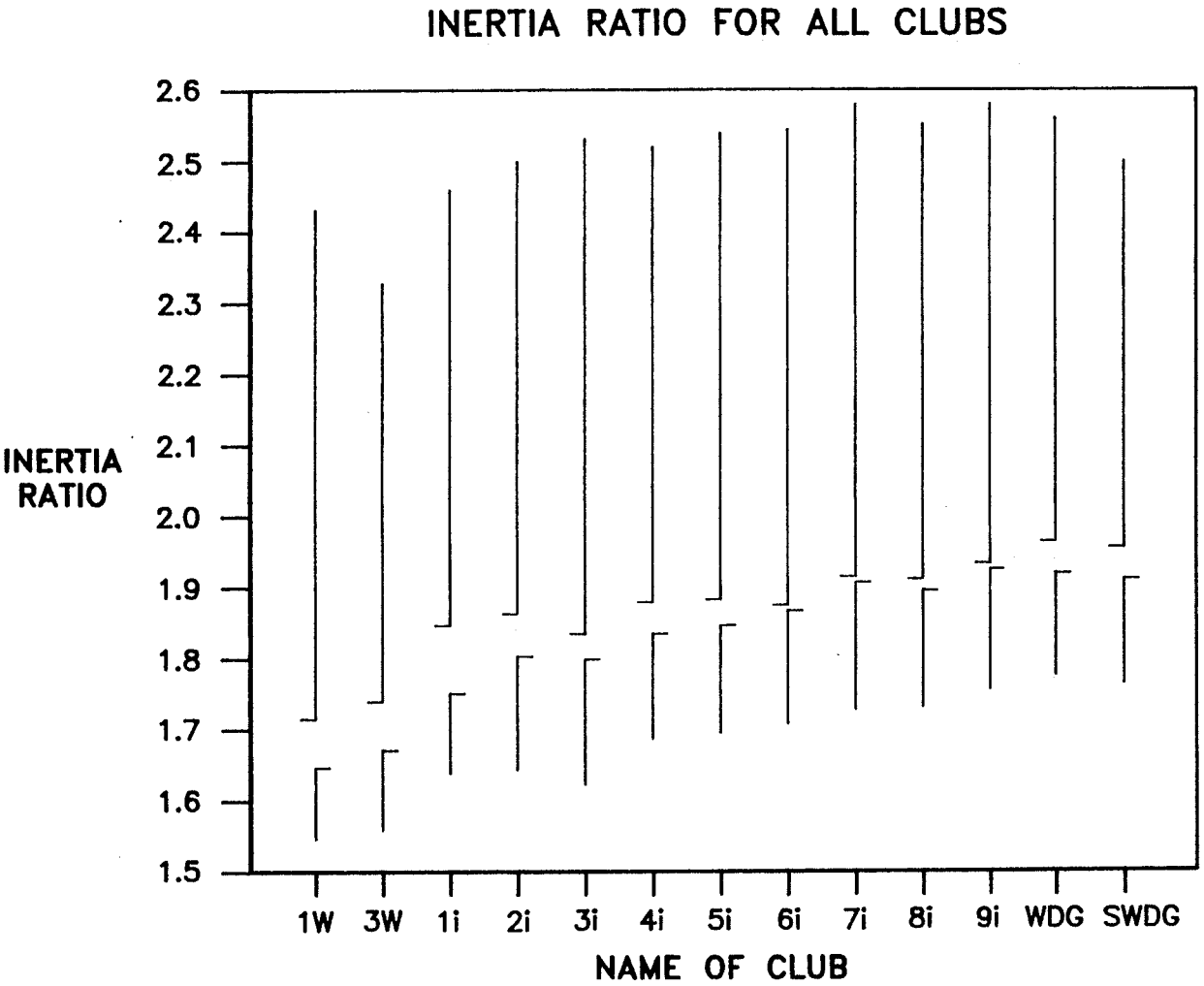
FIG. 2 shows the ratios of the moment of inertia values defined above of the club for the first and second phases of the swing.

The designs of golf clubs have changed significantly over recent years and many technological advances have been made. New materials have been used in place of the conventional iron and wood heads, new shapes of head with better aerodynamics and different weight distribution have been tried, and shafts of reinforced plastic are becoming common, particularly in the United States and Japan. However the fundamental make up of the club remains the same. Of the overall weight of 350 to 500 gms, typically 60% is in the head, 30% in the shaft and 10% in the grip.

The dynamics of the swing of any piece of sporting equipment are complex. The equations of motion are however relatively straightforward and lead to general qualitative solutions. To specify the quantitative solutions for particular cases requires a knowledge of the forces that come into play, applied by the human frame, arms and wrists and these are not well defined. To proceed to a solution previous researchers have therefore used observations of professional swings. The constants in the equations can then be determined from these observations and the calculated patterns of the swing compare well with the actual swing.

Two particular pieces of existing research are relevant to this invention.

1. Williams, D. The Dynamics of the Golf Swing. Quarterly Journ. Mech & Applied Math Vol XX Pt 2 1967.
2. Jorgensen T. On the dynamics of the swing of a golf club. American Journal of Physics. Vol 38 No 5 May 1970.

Although their treatment of the equations is different they both show that there is an 'optimum' way to swing the club to achieve the maximum clubhead velocity at the impact of club and ball, for a given energy input. This maximisation of velocity is very important in that not only does it cause the ball to travel longer distances with the driver and long irons but it causes the generation of much backspin on the ball for short irons, which is essential for good shots to the green. Any deviation from the optimum swing not only reduces the velocity at impact but also significantly changes the line of the swing. The clubhead/ball impact is not square and the ball often slices away on a curve to the right (for a right-handed player). Golfers often refer to this phenomenon as hitting from the top. The significance of this phrase is the essence of this invention.

First consider the implications of the work of Williams and Jorgensen. The optimum swing can be described, beginning from the completion of the backswing, as follows:

The body and arms of the golfer accelerate the club from rest at about 20 $m/s^2$. The wrists remain cocked in the position attained at the top of the swing. This phase continues with the wrists still locked in position for approximately 60 to 65 degrees of rotation of the body with the acceleration rising to 300 $m/s^2$. At this stage, and no earlier, the wrists begin to uncock. The hands continue in an arc at roughly constant velocity and the club rotates with increasing angular velocity about them. The velocity of the clubhead therefore has two components, that due to the speed of the hands and that due to the rotation of the club about them. If the swing has been timed correctly the hands will reach the bottom of the swing at the exact moment that the clubhead reaches the bottom. This is the condition that Williams and Jorgensen refer to as optimum.

The attainment of such a swing is governed by the muscular effort of the swinger and the weight of the components he is swinging. Many muscles are used in the effort and to achieve the optimum they must be combined in a particular way. It is particularly important for the first phase of the swing (where the wrists remain cocked) to encompass the full angle mentioned above. Only then will the uncocking process of the wrists bring the clubhead square on impact and at high speed. Now all tests and research has so far been conducted mainly on professional golfers or golfers with excellent swings. These individuals have generally been brought up to play the game from an early age, or have had the benefit of a natural talent for the game or a good teacher and much practise of the correct manner of swinging. Thus the muscles, and specifically the balance between the muscles, is developed to suit the requirements of a good swing. (An obvious example of this, in another sport, is the gross development of the arm of a professional tennis player). True there are individuals who have what appear to be poor swings even in the ranks of the professional but eventually they acquire the ability to bring the clubhead square at impact. The time and effort to do this is beyond the means of the general amateur player. Most amateurs, particularly men, come to the game when their balance of muscles is very inappropriate to a good golf swing. They have strong back and leg muscles, and moderate upper arm muscles. They are able to lock the wrists in the direction of the line of the arms as would be required for lifting heavy weights, but they lack the ability and strength to control the rotation of the wrists about the arms under a large load. In the swing this load comes from the very large centrifugal accelerations generated at the clubhead during the first phase of the swing. Consider now the swing of an amateur golfer:

The body and arms accelerate the club from rest at the top of the backswing. Being strong in the back and leg this acceleration can be as high and sometimes higher than a professional golfer achieves. (Biomechanical Analysis of a golfer's back. T. M. Hosea; C. J. Gatt, K. M. Gacci, N. A. Langrank, J. P. Zawadsky. Proceedings of the First World Congress of Golf, St. Andrews 1990.) However the weakness of the wrists does not allow him to complete the first phase of the swing with the wrists firmly cocked. The clubhead, under high centrifugal accelerations, begins to rotate about the arms. Because of this the clubhead moves out of the desired plane of the swing and continues to do so for the rest of the swing. Impact is often made with the clubhead moving from the outside to inside of the correct plane. Clockwise spin (looking down on top of the ball) is created on the ball which results in a curved motion of the ball in flight commonly known as a slice. In addition the maximum clubhead velocity is not achieved at impact. The combination of these failings results in a poor shot.

One solution to the problem is to reduce the speed of the club and the arms in the first phase. If this can be made to match the resistance of the wrists at the correct angle of completion of this phase then the subsequent impact will be square. The maximum velocity of the clubhead will now occur at impact but the magnitude of this velocity will be less than the professional, with stronger wrists, can achieve. In effect the result is that the ball will travel straight and true but will carry less distance than the professional's shot produces. This is infinitely preferable to a short slice, the most common shot in golf. Armed with the correct sequencing of the shot the golfer may now, if he wishes, develop the muscles of the lower arm (and only these muscles) to enable him to produce a quicker version of his basically sound new swing thereby achieving longer distances of shot. This definition of the swing also shows why golfers find it easier to swing the 'short' irons since with these clubs the swing angle is much less and the accelerations much smaller. This ideally sequenced swing is often referred to as the grooved swing.

The imbalance of muscular effort is also seen in the young player, particularly if they are also playing another sport more common to school activities than golf. The principles outlined here are equally applicable to this category of player.

The golf professional, and many other knowledgeable teachers, are often heard to remark on the speed of the swing of the amateur. A slower swing is said to produce better 'timing' of the shot. The explanation given above shows why this is the case.

For most amateurs this change to a slower swing is nearly impossible to achieve and another solution to the problem must be sought.

From a technical appreciation of the swing, a study of an analysis of the mathematics of it and a deep knowledge of the game from the points of view of the amateur and the professional, we have invented a club which aids the amateur to generate the correctly sequenced swing. It is of benefit to all amateurs who, no matter what their standard, will hit bad shots and to professionals in that it is more controllable.

The technical explanation of the design is as follows. Jorgensen shows that the equations of motion of the swing result in:

$$T_s = \theta\,[J + MR^2 + RS\cos(\quad - \theta)] + \quad [I + RS\cos(\quad - \theta)] - [\quad^2 - \theta^2]\,RS\sin(\quad - \theta)$$

$$T_c = \quad I + \theta\,RS\cos(\quad - \theta) + \theta^2\,RS\sin(\quad - \theta)$$

$T_s$ = torque applied to the system by the golfer
$T_c$ = torque applied to the club
$J$ = moment of inertia of the arms taken about an axis through the spine about which the arms swing.
$M$ = total mass of the club.
$I$ = moment of inertia of the club about the golfers wrists
$S$ = first moment about the same axis
$R$ = effective length of the golfers arms
= angle between the club and the horizontal
$\theta$ = angle of rotation of the system from the horizontal The torque $T_c$, applied to the club basically involves the first moment (S) and moment of inertia (I) the club about the golfers wrists. If these can be decreased then the torque reduces. In consequence the amateur golfer would find it much easier to control the natural uncocking of the wrists and delay this process until the correct period of the swing. In addition the professional golfer will find the club easier to manipulate for different types of shot. These moments involve the mass of the clubhead, the mass of the shaft and the length of the shaft. It is noted that the last quantity decreases for the short irons but the head weight is increased to keep the swing weight (which is in effect the first moment) constant. Assuming therefore that the shaft weight remains the same, the mass of the head would need to be reduced to reduce $T_c$. This can be easily done by redesigning the head accordingly. However, the same terms appear in the first equation for the torque $T_s$, applied by the body and legs. In essence therefore the balance has not been changed between the two components of torque and what will be achieved is merely a faster version of the incorrectly sequenced swing. This in part, explains why lightweight clubs have never been successful. If significant weight is now added to the club below but in the vicinity of the golfers hands two effects occur. First the overall weight of the club increases. This increases the torque $T_s$ (by virtue of the term $MR^2$) and reduces the speed with which the club is swung from the top. The torque $T_c$, of the second phase remains virtually unaltered since the weight is placed high on the shaft. We have therefore achieved a change to the balance of the club, and therefore the balance of muscular effort required to swing it, which can be made to match the requirements of the amateur golfer. This club design increases the moment of inertia to maintain a slow swing from the top in the first phase which, because of the much reduced moment of inertia about the wrist-cock axis, can now be completed without the wrists uncocking, thereby producing the correct sequencing of the swing.

FIG. 1 for instance shows the percentage decrease in the ratio $T_s/T_c$ for a 6 iron and a driver, for different added weights and different positions of these weights. It is concluded from this that the position of the weight is much less important than the magnitude of the weight. Larger changes to the ratio come with larger added mass. A comparison is also shown for a lightened head. A balance has to be struck between achieving a significant change to the ratio between the torques required in each phase and the difficulty of swinging a heavy club. In essence it would be preferable therefore to keep the moment of inertia over the first phase of the swing high whilst having a low moment of inertia in the second phase. This can be done by combining the two changes described in FIG. 1, using a light head mass and a separate added mass in or near the gripping area.

FIG. 2 plots the calculated results of doing this for a range of values of head mass and added weight. The lower vertical lines show the range of inertia ratios.

$$(I+MR^2)/I$$

for current clubs. Within each range are ladies clubs, heavy headed gents clubs, using composite and steel shafts in a range of lengths. By decreasing head weights from the current range by between 13% and 30% and adding suitable weights in various locations at or below the gripping area, the inertia ratios are greatly increased. The upper vertical lines show the range achieved again using ladies clubheads, gents clubheads and composite or steel shafts of various lengths. The criteria used in FIG. 2 for these calculations is that the inertia for the first phase should be within ±5% of the value for the standard club and the inertia for the second phase should be reduced by at least 20%. In fact values up to 30% are contained in the range.

It should be noted that the range of ratio values is very much larger than in current clubs, enabling the designer to select clubs for the wide range of abilities of golfers.

Another benefit of the design is also shown in FIG. 2. Whereas the inertia ratio for a current driver is much less than for a current seven iron, reflecting the greater difficulty in using the driver, it is possible with the proposed invention to design clubs which have roughly constant ratios across the range of loft and length values.

The weight added to the shaft of the club below the centre of gravity of the hands is preferably greater than 50 gms and may be between 80 and 160 gms. The centre of gravity of the additional weight is preferably within a distance of 300 mm from the butt end of the shaft, but below the centre of gravity of the hands.

The head of the club is preferably lightened in accordance with the additional weight but by a lesser amount. In the above examples 30 gms and between 40 to 50 gms is preferably removed from the head respectively.

Tests on clubs designed with this principle show that 75 to 150 gms added below the grolfer's hands is able to produce good conditions for all of the golfers tested. In addition, tests on a professional swing show that the clubhead is easier to control. The golfer can rotate the head and bring it to square on impact much more easily than with the standard head.

Figure 22:
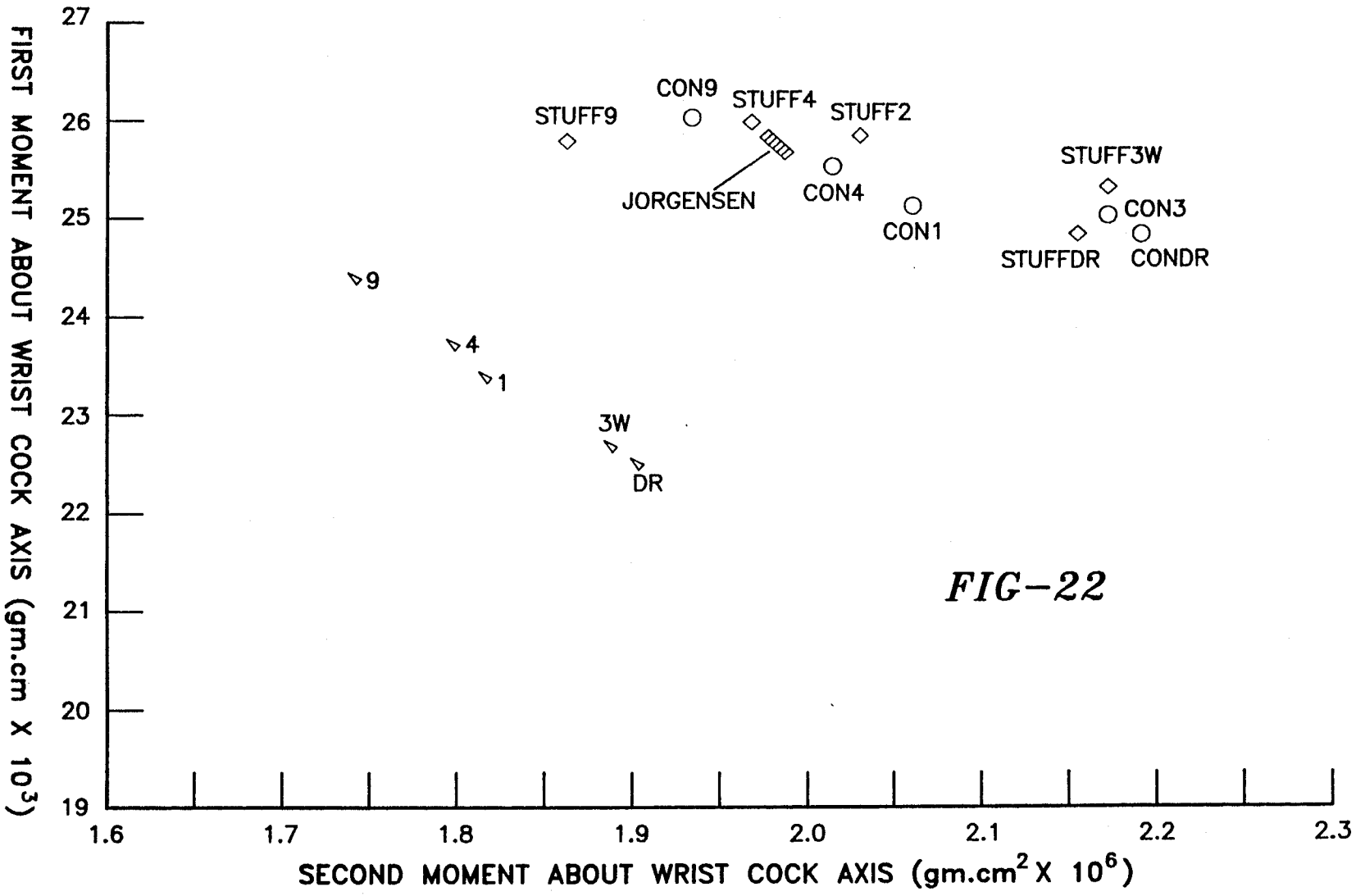
FIG. 22 is a graph showing the comparative values for the first moment about the wrist-cock axis and the moment of inertia about the wrist-cock axis as defined for clubs designed accordingly to the present invention and for known clubs designed according to the design criteria set out in various U.S. prior art patents and for known golf clubs presently being marketed.

With reference now to FIG. 22 in order to illustrate the substantial differences between the moments of inertia in the second phases of the golfer's swing compared to prior art clubs, these have been plotted as first moment about the wrist-cock axis and moment of inertia about the same axis for conventional clubs presently on the market and also for a number of clubs which have been modified for specific reasons and which have been patented in the USA, and clubs designed according to the present invention.

Referring now to FIG. 22, the first moment about the wrist-cock axis is plotted on the "Y" axis and the moment of inertia about the same axis on the "X" axis. This is often called the second moment. The first moment is in gm cm$\times 10^2 \times 10^6$. The graph is similar to the plot of FIG. 3 of U.S. Pat. No. 4,415,156, the values being calculated in the same manner.

For the purposes of the present invention, the first moment (M1) and moment of inertias are defined as follows:

$$M1 = M_h \cdot L_h + M_s \cdot L_s + M_w \cdot L_w$$

$$M2 = M_h \cdot L_h^2 + M_s \cdot L_s^2 + M_w \cdot L_w 2$$

where $M_l$, $M_s$ and $M_w$ are the masses of the head, the shaft and the additional weight if added ($M_w$ is zero for the prior art cases), and $L_h$, $L_s$ and $L_w$ are distances between the centres of gravity of the head, the shaft and the added weight and the position of the centre of the golfer'hands. There is an additional term from the mass of the grip but its centre of gravity is very close to the position of the centre of the golfer's hands and therefore the contribution to both the moment from the grip are negligible.

Turning now to specific plots on the graph and again with cross reference to U.S. Pat. No. 4,415,156 the clubs designed by Jorgensen are shown by the black rectangle. These have a first moment M1 between $25.7 \times 10^3$ to $25.9 \times 10.3^3$ gr cm and a second moment between $1.97 \times 10^6$ to $1.98 \times 10.^6$ gm cm$^2$.

In Jorgensen U.S. Pat. No. 4,415,156 the conventional clubs are also shown in FIG. 2 and these are also shown as CON 9 (9 iron), CON 4 (4 iron), CON 1 (1 iron), and CON DR (Driver). Club CON 9 has a first moment M1 of $26.0 \times 10^3$ gm cm and a second moment M2 of $1.93 \times 10^6$ gm cm$^2$. The driver CON DR. has a first moment of $24.9 \times 10^3$ gm cm and a second moment of $2.1 \times 10^6$ gm cm$^2$.

It can therefore be seen that Jorgensen produces a set of clubs which are matched in inertias of both the first and second moment as compared with those of a conventional club. However these inertia values are high being higher than $25.8 \times 10^3$ gm cm (M1) and $1.97 \times 10^6$ gm cm$^2$ (M2).

U.S. Pat. No. 4,058,312 (Stuff et al) relates to an invention wherein the centre of gravity of each club in a set is for all clubs in a set. The values for the first and second moments for the clubs in Chart II (U.S. Pat. No. 4,058,312) Stuff et al are shown in FIG. 22 for the 9 iron, (Stuff 9), 4 iron (Stuff 4), 2 iron (Stuff 2), 3 wood (Stuff 3W) and Driver (Stuff DR).

It may be seen that the values of the first moment for the clubs in Stuff et al are high being approximately between 25 and $26 \times 10^3$ gm cm. The spread of the second moments are substantial being between 1.86 to $2.19 \times 10^6$ gm cm$^2$. Thus in the second phase of movement for the Driver and second moment of inertia is approximately as high as that for a convention driver.

Hence the set of clubs designed by Stuff et al are more difficult to use than conventional clubs because they have a very wide spread for the second moment of inertia.

U.S. Pat. No. 4,128,242 (Elkins) also discloses a modified set of golf clubs to provide a corrected set, in much the same manner as U.S. Pat. No. 4,415,156 Jorgensen with the addition of constant total weight and this is illustrated by the hatched circle labelled "Elkins-all clubs" which shown that both the first and second moments of these clubs are indeed carefully matched.

It is found however that both moment are well above those for normal clubs, the first moment being approximately $27.2\times10^3$ gm cm and the second moment $2.25\times10^6$ gm cm$^2$. These clubs are therefore very difficult to swing.

In comparison, the clubs designed according to the present invention wherein weight is removed from the head and wherein an additional weight is placed beneath but close to the hands, are much easier to swing, in the second phase of movement.

Reference is now made particularly to the Driver, this being traditionally regarded as the most difficult club to swing. For the conventional driver, the Stuff Driver and the Elkins driver the second moments are all greater than $2.15\times10.^6$ gm cm$^2$ whereas for the driver of the present invention the second moment is a maximum of $1.9\times10^6$ gm cm$^2$ for a head weight reduction of 30 gms shown in FIG. 22, a decrease of over 10%. The Jorgensen driver is at approximately $1.970\times10^6$ gm cm$^2$ and thus the decrease is not as marked.

Comparing now the first moments for the drivers, it is noted that the conventional, Stuff and Jorgensen and Elkins drivers are all above $24.9\times10^3$ gm cm whereas the driver according to the present invention is $22.4\times10^3$ gm cm again showing a 10% reduction over the prior art range of clubs.

Figure 23:
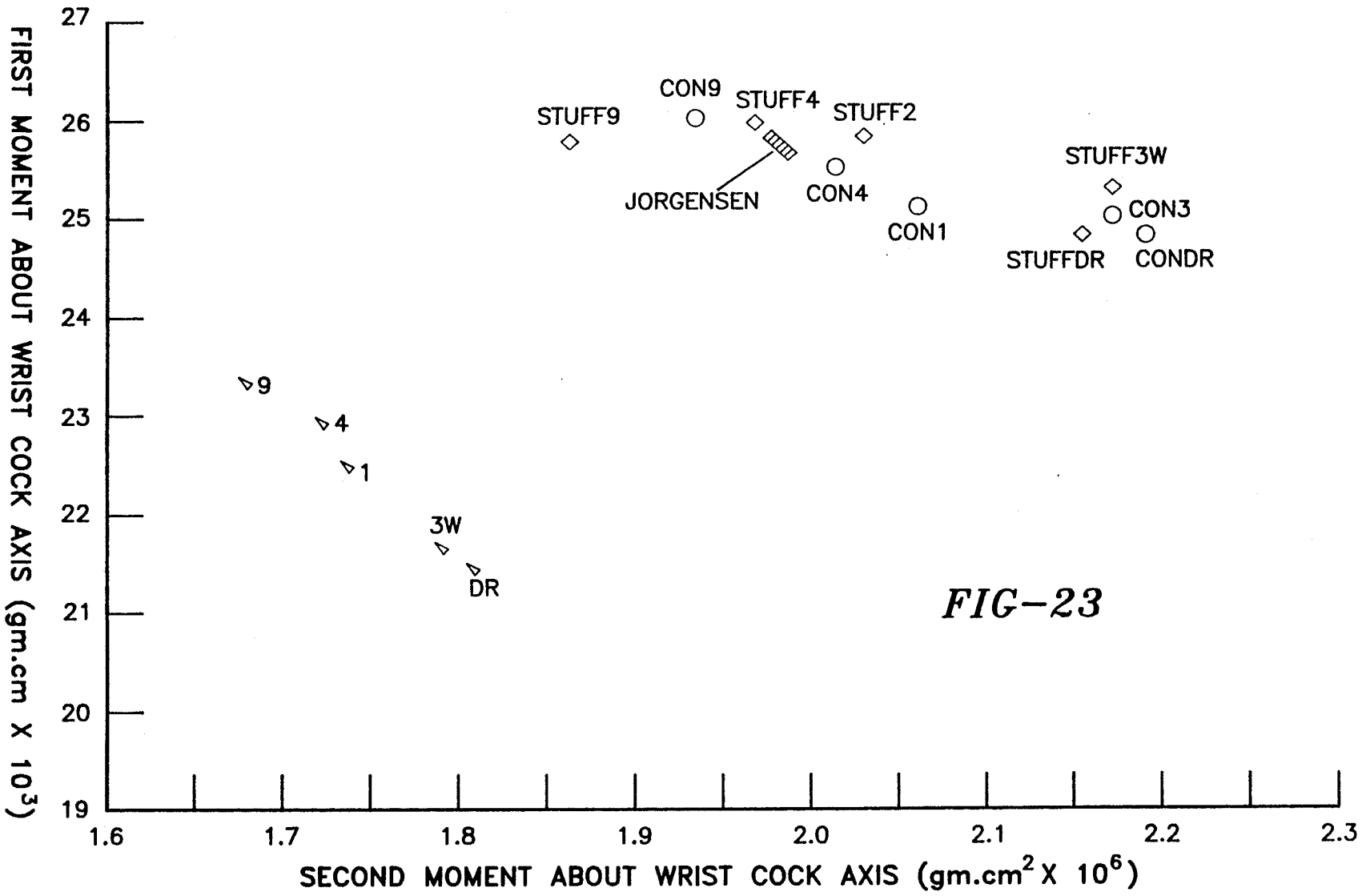
FIG. 23 is a further graph similar to FIG. 22 but with a weight reduction in the head of 40 gms.

With reference now to FIG. 23 which shows the effect of reducing head weight by 40 gms and introducing the additional weight just below the hands, as described above, the effects are even more marked. The first moment is reduced to below $21.5\times10^3$ gm cm and the second to $1.805\times10^6$ gm cm$^2$ giving a 10% reduction compared with Jorgensen ($1.98\times10^6$ gm cm$^2$ to $1.805\times10^6$ gm cm$^2$) and an approximate 18% reduction in second moment compared with conventional clubs.

Figure 24:
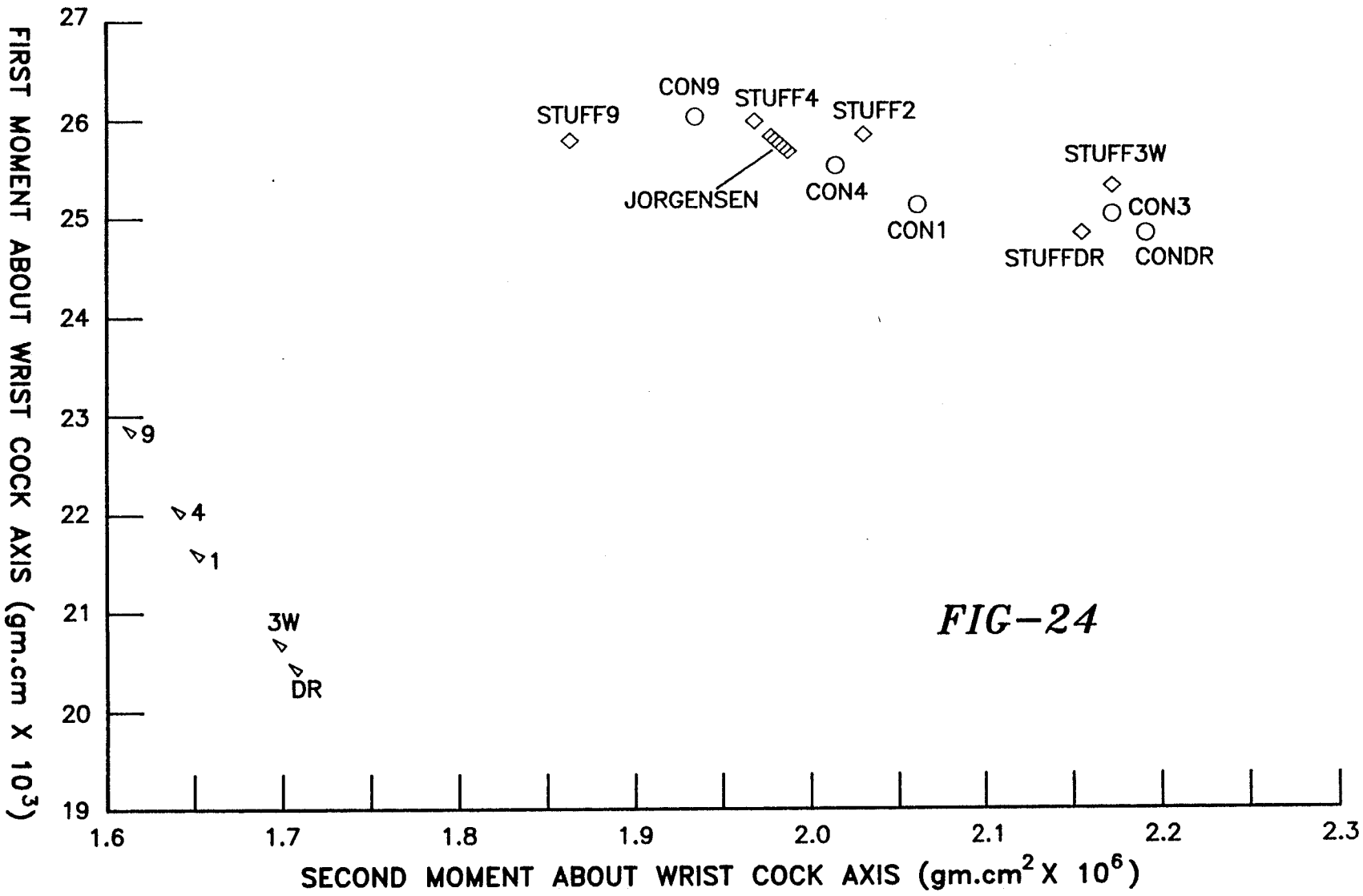
FIG. 24 is a further graph similar to that of FIG. 22 but with a weight reduction in the head of 50 gms.

With reference to FIG. 24 which shows the effect of reducing head weight by 50 gms and introducing additional weight just below the hands, within 0–4 inches as described above the effects are further marked.

Again, concentrating on the driver, the first moment is $20.4\times10^3$ gm cm as against $24.9\times10^3$ gm cm for Stuff and $25.7\times10^3$ gm cm for Jorgensen and the second moment is $1.705\times10^6$ gm cm$^2$ as against $2.15\times10^6$ gm cm$^2$ for Stuff and $1.98\times10^6$ gm cm$^2$ for Jorgensen.

Thus the second moment is reduced by approximately 22% and with respect of conventional clubs and by approximately 14% with respect of the special design of clubs in the Jorgensen patent.

Thus the clubs designed in accordance with the present invention are substantially easier to swing, particularly in the second phase of movement of the golfer's swing.

From the graphs of FIGS. 22 to 24 it may be seen that the other woods and irons (3W [3 wood] to 9 [09 iron]) are similarly much easier to swing in the second phase of movement, the nine iron in FIG. 24 having an inertia of only 1.61 as compared with a conventional 9 iron at 1.93.

The reduction in inertia during the second part of the swing reduces the torsional effects on the golfer and in addition to making the club easier to swing reduced the strain imposed on the golfer. The club head, being more easily controlled will be more likely to strike the golf ball correctly thereby giving a better chance of a straight perfectly timed shot.

FIGS. 25 and 26 illustrate the calculated additional weight positions for the clubs illustrated in FIGS. 22 and 23.

In these examples the core position (centre of gravity) have been set at constant distances from the butt end of the shaft, 6 inches for the wood clubs and 8 inches for the irons.

The figures also illustrate the variation of calculated core weight throughout the set and between sets.

The trimming details show for a particular example of club the way in which each end of a standard core weight insert is trimmed to achieve the desire result.

Finally, the forces causing bending of the shaft are lower. The accelerations throughout any swing are large, particularly during the important second phase. These act through the centre of gravity of the system, which for most golf clubs is offset from the line of the shaft. This offset force produces significant bending in the shaft which will be reduced if the proposed design is adopted, and there is less weight in the head. With less bending the face of the club is less angled on impact. The shaft is therefore redesigned if necessary to compensate for this.

Design of Golf Club

Typical designs are shown in FIGS. 3 and 4. In FIG. 3 the additional weight W, of at least 50 gms, is placed in or around the gripping area of the club with its centre of gravity within 300 mm of the butt end of the shaft. This may be distributed as a solid (FIGS. 4*a*, 4*e*) or hollow section (FIGS. 4*c*, 4*d*) typically over 10 cms, or as a concentrated load (FIG. 4*b*) such as a spherical ball B placed firmly into the tube up to 300 mm from the butt end supporting lead shot L held in place by a cork C. The ball fixing has the advantage that contact is made with the tapered shaft over a small area thus creating the least change to the handling characteristics of the shaft. With any of the distributed weight systems the shaft may be slightly stiffened over the area of contact producing less deflection and a different flex point in the shaft. Calculations show that the stiffening effect is very small on most shafts but the same calculations can be used to redesign the shaft to have the original desirable characteristics.

In FIG. 4*d*, the shaft is shown made of stepped steel in the conventional way with a thicker section. In shafts of reinforced plastic the weight, in any of the forms mentioned above, can be cast in during the manufacture of the shaft.

The clubhead must be lighter than standard. For the wooden headed club removal of the central section of the head around the centre of gravity and the lead weight normally placed there would produce a weight reduction of 15 to 25 gms. It is essential to remove more than this, but since this is impracticable for strength reasons, a redesign of the clubhead will be required. More ideal is the metal headed wood which is cast. This clubhead can either be made from lighter material of sufficient strength or by removing metal from least sensitive stress areas. The irons can be treated similarly, using lighter materials or conventional materials of different design, perhaps with hollow sections.

With reference now to FIGS. 5 to 7 the principal of operation of the golf club according to the present invention will now be explained in further detail and will be contrasted with a known prior golf club described in U.S. Pat. No. 4,058,312 (Stuff) the principal of operation of which is shown in FIGS. 8 to 10.

With reference to FIG. 5, the golf club comprises a shaft 100, a head 200 and a grip 300. The golf club is gripped by a players hands in the area of grip 300 and the club when swung by the golfer has a pivot point P (illustrated as conventionally shown for pivots) which is generally between the two hands of the golfer and which is thereby within the length of the grip 300. The grip of a typical golf club is in known manner comprised of a rubber sleeve which is slid over the butt end of the shaft 100 and is typically 10 to 12 inches in length. The grip is tapered and is a force fit on the shaft. The hands of a golfer obviously vary in the size but they are on average approximately 4 inches across the palm and thus in known manner both hands fit on the grip 300. It is universally accepted that the centre of the golfer's hands is 4 inches below the butt end of the club.

With reference to FIGS. 6 and 7 the additional weight +W is added (see hereinbefore with reference to FIG. 1) such that its centre of gravity is below the pivot point P (see hereinafter FIGS. 14–21).

This provides a positive lever for the golfer which is contrasted with the known prior art club shown in FIGS. 8, 9 and 10 wherein the added weight +W is provided above the pivot point P, this arrangement providing a counter lever.

By contrast, therefore, and with reference particularly to FIGS. 6 and 9 when the golfer G, (depicted by a triangle representing the shoulder width SW, arm lengths AL1 and AL2 the golfer's head being represented by a black circle) swings the golf club above his head, the weight +W in FIG. 6 provides a positive lever weight whereas in FIG. 9 it provides a counter weight. In the known arrangement of FIGS. 7 to 10 the club when raised above the golfers head feels extremely light, the golfer having no feeling of inertia about the hands when the club is in this position. This is because the club is counterbalanced. Thus the golfer has great difficulty in controlling the club over the first part of the swing. In the second part of the swing the club is turned as the wrists are uncocked and the counterbalance weight in FIG. 10 then performs the function described in U.S. Pat. No. 4,058,312 but it is in the first or upper part of the swing that the problem arises.

By contrast in the club according to the present invention the added weight +W being below the hands provides a positive lever when the club is lifted above the head in the upper or first position (FIG. 6) and thus the club has a heavier feel to it somewhat similar to a conventional club and thus the club does not have a light feel in the backswing therefore producing a much more controlled swing. Since, in the club according to the present invention, weight −W is taken out of the head the inertia in the first part of the swing shown in FIG. 6 is substantially the same as for conventional designed golf clubs but with reference to FIG. 7 the inertia in the second part of the golf swing is reduced because the head weight is reduced and the head, in the second and lower part of the swing is further from the shoulders as can be clearly seen by reference to FIGS. 6 and 7.

Figure 11:
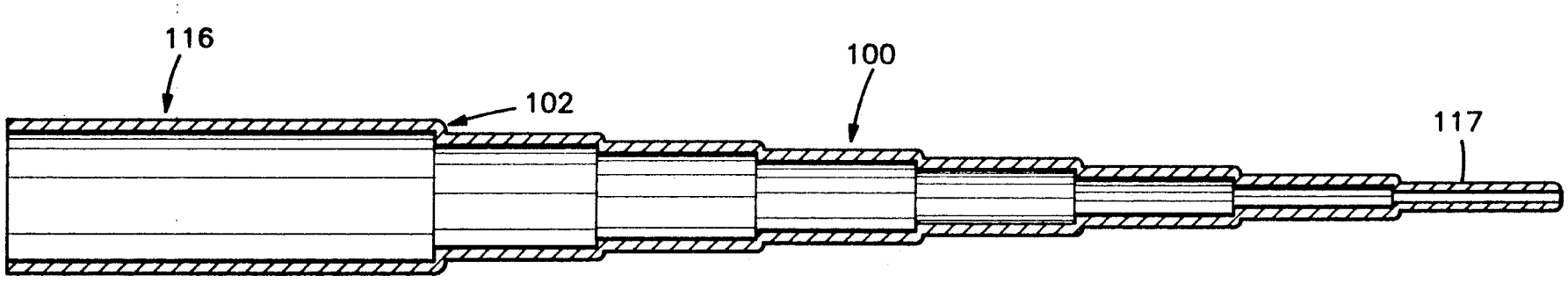
FIG. 11 shows a known, commonly used tapered shaft for a golf club in longitudinal cross section.

With reference now to FIG. 11 there is shown a known conventional golf club shaft 100. Such shafts are in the common use and, therefore, the shaft will not be described in detail. The shaft is made of tapered steel and is tapered in steps 102 to provide the desired strength and bending characteristics. The shaft is generally circular in cross section. Alternatively, the shaft could be parallel throughout its length or tapered throughout its length.

The centre of gravity of the added weight +W is required to be below the hands and it must not move during the life of the club. Also preferably it must not rattle or come loose as this will considerably detract from the attractiveness of the club.

Figure 12:
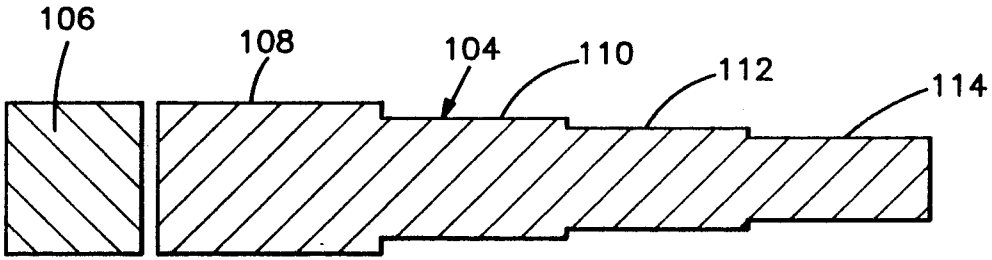
FIG. 12 shows a further embodiment of an added weight for insertion into the multi-stepped shaft of FIG. 6 and a securing means for the weight.
Figure 13:
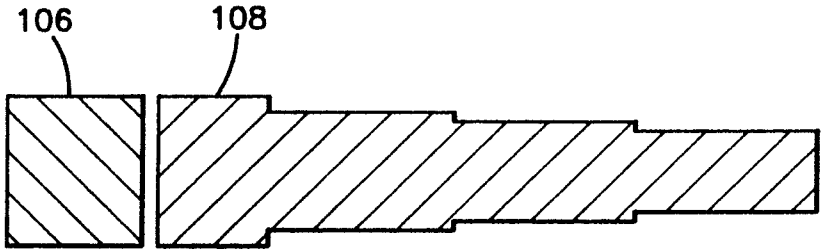
FIG. 13 shows a modification of the added weight for various clubs.
Figure 14:
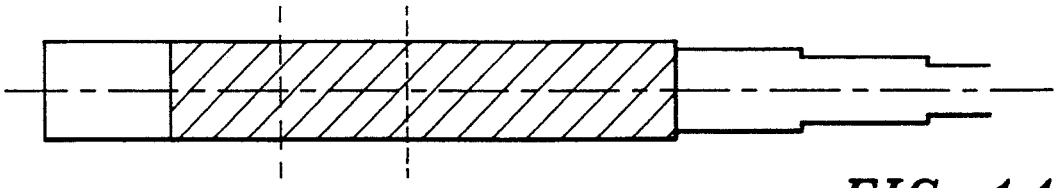
FIG. 14 shows diagrammatically the butt end portion of a Driver illustrating the position of an added weight of the type shown in FIGS. 7 or 8; but in a special shaft with a long parallel section at the butt end.
Figure 15:
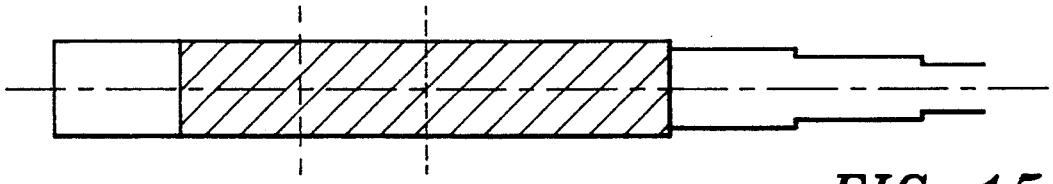
FIG. 15 shows diagrammatically the butt end portion of a 3 wood shaft illustrating the position of an added weight of the type shown in FIGS. 7 or 8; in the same shaft as FIG. 14.

One preferred method for adding the weight is shown in FIGS. 12 and 13. The additional weight +W comprises an elongate rubber insert 104 which is shaped in a step tapered manner and is contoured to fit into the inside of shaft 100. The selected rubber preferably has specific gravity between 3.0 and 4.0. Preferably the maximum length of the insert is in a preferred embodiment 20 cm (8 inches).

The rubber insert 104 is preferably held in position by a bung 106 which is preferably of polyurethane material.

The length of the rubber insert 104 is preferably adjusted as shown in FIG. 13 by shortening the end portion 108, the step tapered portions 110, 112, 114 remaining intact and thereby retaining the contoured feature. Thus the rubber insert may be trimmed at portion 108 to adjust the weight to be added and also to adjust to the length of the weight to the length of club which may vary from driver to said iron. FIGS. 14–21 show a preferred embodiment where the shaft has been designed to have a long parallel section at the butt end.

With reference to FIGS. 14 to 21 the shafts for all golf clubs in a particular set are usually identically manufactured but cut to different lengths by shortening the butt end 116 or the tip end 117 (see FIG. 11).

Figure 16:
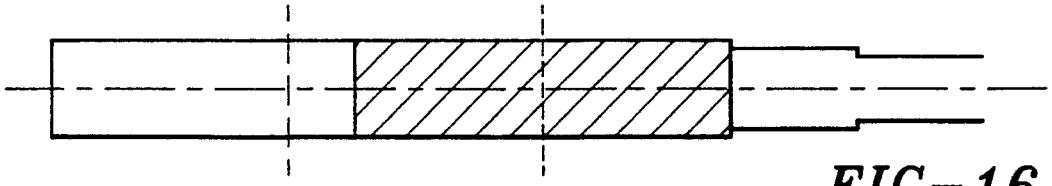
FIG. 16 shows diagrammatically the butt end portion of a 1 iron shaft illustrating the position of an added weight of the type shown in FIGS. 7 or 8; in the same shaft as FIG. 14.
Figure 17:
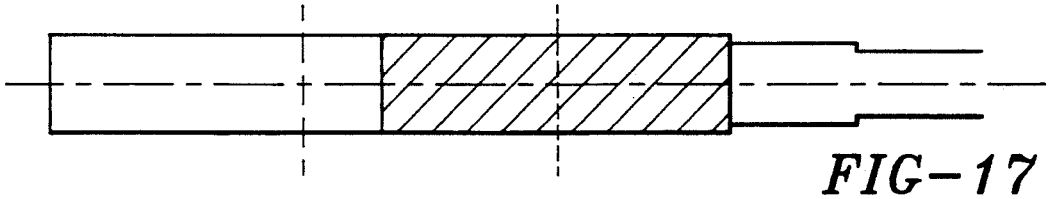
FIG. 17 shows diagrammatically the butt end portion of a 3 shaft illustrating the position of an added weight of the type shown in FIGS. 7 or 8; in the same shaft as FIG. 14.
Figure 18:
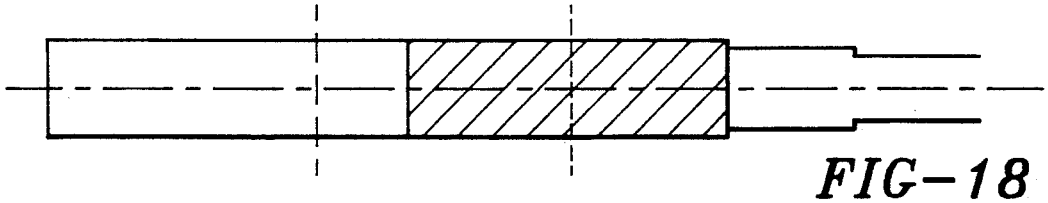
FIG. 18 shows diagrammatically the butt end portion of a 5 shaft illustrating the position of an added weight of the type shown in FIGS. 7 or 8; in the same shaft as FIG. 14.
Figure 19:
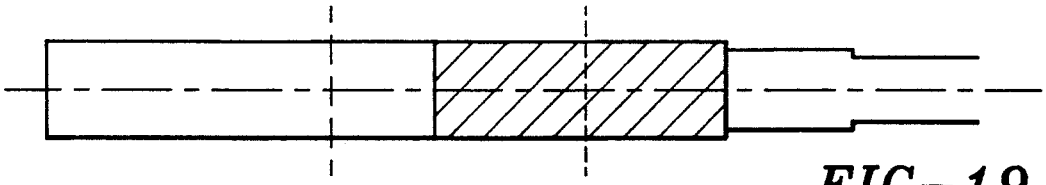
FIG. 19 shows diagrammatically the butt end portion of a 7 iron shaft illustrating the position of an added weight of the type shown in FIGS. 7 or 8; in the same shaft as FIG. 14.
Figure 20:
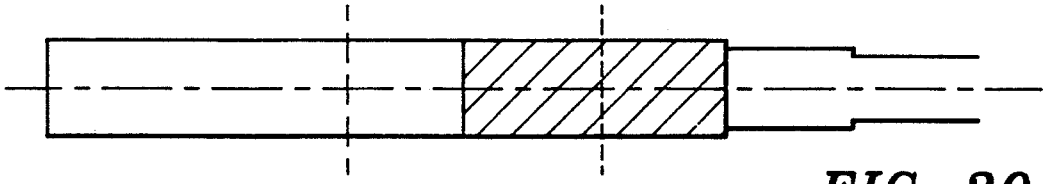
FIG. 20 shows diagrammatically the butt end portion of a 9 iron shaft illustrating the position of an added weight of the type shown in FIGS. 7 or 8; in the same shaft as FIG. 14.
Figure 21:
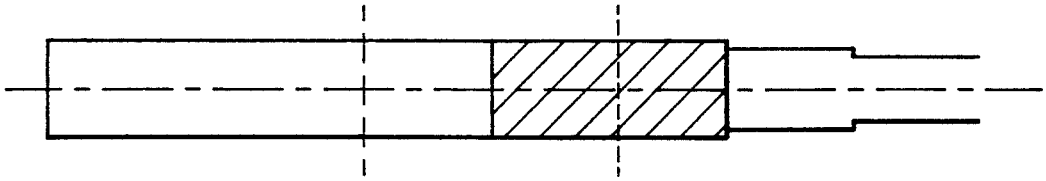
FIG. 21 shows diagrammatically the butt end portion of a wedge shaft illustrating the position of an added weight of the type shown in FIGS. 7 or 8; in the same shaft as FIG. 14.

This is illustrated in FIGS. 16 to 21 by the step in the shafts being vertically aligned and wherein it may be seen that the butt end portion 116 on the wedge (FIG. 21) is shorter than on the 1 iron (FIG. 16).

The rubber insert 104 is also preferably cut to length (or designed to a specific length) which varies as shown being longer for the 1 iron and shorter for the 3, 5, 7, 9 and wedge. It will be seen that it is obvious that for the other clubs (the 2, 4, 6, 8 irons and sand wedge) not shown, the lengths of shaft and insert will be respectively intermediate to those shown.

The centre of gravity (CG) of both the hands and the insert (added weight) is shown for each club. It may be seen that the CG of the insert is always well below the CG of the hands. The two centres are furthest apart for the longer irons (e.g. the 1 iron) and closer together for the shorter irons (e.g. the wedge) but the CG of the added weight is always below the CG of the hands. By suitably designing and trimming the shaft it is possible to make the distance between the two CGs constant throughout the set.

The term CG of the hands is used here since this is easier to define by virtue of the position of the hands on the grip, than the pivot point P. The pivot point P will be substantially the same as the CG of the hands but will for most practical applications be in substantially the same position. The CG of the hands is essentially the centre point between the two hands on the grip. With reference to FIGS. 16–21 it may be seen that the whole of the added weight +W will be below the CG of the hands with the CG of the weight at a substantial distance below the CG of the hands. In contrast in FIGS. 14–15 with the wood clubs shown the CG of the hands is much closer to the CG of the weight. Hence the bottom hand may in this example overlap the top end of the added weight but the CG of the added weight will still be below the CG of the hands as shown.

We claim:

1. A set of golf clubs wherein each golf club in the set has a different length and is weighted such that during a downswing of a club by a golfer a moment ($M_1$) and a second moment of inertia ($M_2$) about a wrist-cock axis are controlled wherein the wrist-cock axis is an axis perpendicular to the longitudinal axis of the shaft about which the golfer breaks his wrists during the downswing of the club, each golf club comprising: a shaft having a butt end and a head end, and a distinct grip disposed on said shaft and extending from said butt end of the shaft toward said head end and defining a normal gripping area for gripping the club by the golfer and including a normal central position located about 4 inches below the butt end of the shaft, a head affixed to the head end of the shaft, and an additional weight provided on the shaft adjacent to the gripping area such that the balance of the club is altered, the additional weight being positioned at a calculated position adjacent the gripping area and the mass of the additional weight being calculated in accordance with the weight of the head to achieve an inertia ratio $(I+MR^2)/I$ of the golf club of greater than 2.0 wherein I is the moment of inertia, M is the total weight of the golf club and R is the effective length of the golfer's arms wherein the center of gravity of the additional weight is between 0 to 4 inches below the normal central position of the golfer's hands on the gripping area such that (1) the moment ($M_1$) about the wrist-cock axis during movement of the golf club during the downswing of the golf club is less than $24.5\times10^3$ gm cm and (2) the moment of inertia ($M_2$) about the wrist-cock axis during movement of the golf club during the downswing of the golf club between uncocking of the golfer's wrists and the striking of a ball is less than $1.9\times10^6$ gm cms$^2$.

2. A set of golf clubs according to claim 1 wherein the additional weight is at least 50 grams.

3. A set of golf clubs according to claim 2 wherein the additional weight is between 80 to 160 grams.

4. A set of golf clubs according to claim 3 wherein the shaft of each golf club is hollow and wherein the additional weight is mounted within the shaft.

5. A set of golf clubs according to claim 4 wherein the center of gravity of the additional weight is within 12 inches of the butt end of the shaft of each golf club.

6. A set of golf clubs according to claim 4 wherein the shaft of each golf club is tapered in a step-wise manner and wherein the additional weight comprises a flexible insert shaped to conform to the internal taper of the shaft of each golf club.

7. A set of golf clubs according to claim 6 wherein the flexible insert comprises a rubber compound having a specific gravity of between 3.0 to 4.0.

8. A set of golf clubs according to claim 6 further including means for preventing movement of the insert within the shaft, said means comprises a polyurethane bung.

9. A set of golf clubs according to claim 6 wherein the flexible insert is held in place within the shaft of each golf club by adhesive.

10. A set of golf clubs according to claim 6 wherein the length of the insert is dependent on the length of the shaft of each golf club.

11. A set of golf clubs according to claim 10 wherein the length of the insert is between 3 to 10 inches.

12. A set of golf clubs according to claim 11 wherein the rubber compound includes a high density filler.

13. A set of golf clubs wherein each golf club in the set has a different length and is weighted such that during a downswing of a club by a golfer a moment ($M_1$) and a second moment of inertia ($M_2$) about a wrist-cock axis are controlled wherein the wrist-cock axis is an axis perpendicular to the longitudinal axis of the shaft about which the golfer breaks his wrists during the downswing of the club, each golf club comprising: a shaft having a butt end and a head end, and a distinct grip disposed on said shaft and extending from said butt end of the shaft toward said head end and defining a normal gripping area for gripping the club by the golfer and including a normal central position located about 4 inches below the butt end of the shaft, a head affixed to the head end of the shaft, and an additional weight provided on the shaft adjacent to the gripping area such that the balance of the club is altered, the additional weight being positioned at a calculated position adjacent the gripping area and the mass of the additional weight being calculated in accordance with the weight of the head to achieve an inertia ratio $(I+MR^2)/I$ of the golf club of greater than 2.0 wherein I is the moment of inertia, M is the total weight of the golf club and R is the effective length of the golfer's arms wherein the center of gravity of the additional weight is between 0 to 4 inches below the normal central position of the golfer's hands on the gripping area such that (1) the moment ($M_1$) about the wrist-cock axis during movement of the golf club during the downswing of the golf club is less than $23.5\times10^3$ gm cm and (2) the moment of inertia ($M_2$) about the wrist-cock axis during movement of the golf club during the downswing of the golf club between uncocking of the golfer's wrists and the striking of a ball is less than $1.8\times10^6$ gm cms$^2$.

14. A set of golf clubs according to claim 13 wherein the additional weight is at least 50 grams.

15. A set of golf clubs according to claim 14 wherein the additional weight is between 80 to 160 grams.

16. A set of golf clubs wherein each golf club in the set has a different length and is weighted such that during a downswing of a club by a golfer a moment ($M_1$) and a second moment of inertia ($M_2$) about a wrist-cock axis are controlled wherein the wrist-cock axis is an axis perpendicular to the longitudinal axis of the shaft about which the golfer breaks his wrists during the downswing of the club, each golf club comprising: a shaft having a butt end and a head end, and a distinct grip disposed on said shaft and extending from said butt end of the shaft toward said head end and defining a normal gripping area for gripping the club by the golfer and including a normal central position located about 4 inches below the butt end of the shaft, a head affixed to the head end of the shaft, and an additional weight provided on the shaft adjacent to the gripping area such that the balance of the club is altered, the additional weight being positioned at a calculated position adjacent the gripping area and the mass of the additional weight being calculated in accordance with the weight of the head to achieve an inertia ratio $(I+MR^2)/I$ of the golf club of greater than 2.0 wherein I is the moment of inertia, M is the total weight of the golf club and R is the effective length of the golfer's arms wherein the center of gravity of the additional weight is between 0 to 4 inches below the normal central position of the golfer's hands on the gripping area such that (1) the moment ($M_1$) about the wrist-cock axis during movement of the golf club during the downswing of the golf club is less than $23.0\times10^3$ gm cm and (2) the moment of inertia ($M_2$) about the wrist-cock axis during movement of the golf club during the downswing of the golf club between uncocking of the golfer's wrists and the striking of a ball is less than $1.7\times10^6$ gm cms$^2$.

17. A set of golf clubs according to claim 16 wherein the additional weight is at least 50 grams.

18. A set of golf clubs according to claim 17 wherein the additional weight is between 80 to 160 grams.

19. A method of designing a set of golf clubs wherein each golf club in the set has a different length and includes a shaft having a butt end and a head end, and a distinct grip disposed on said shaft and extending from said butt end of the shaft toward said head end and defining a normal gripping area for gripping the club by a golfer and including a normal central position located about 4 inches below the butt end of the shaft and a head affixed to the head end of the shaft and wherein each club is weighted such that during the downswing of a club by the golfer a moment ($M_1$) and moment of inertia ($M_2$) about a wrist-cock axis is controlled wherein the wrist-cock axis is an axis perpendicular to the longitudinal axis of the shaft about which the golfer breaks his wrists during the downswing of the club thereby achieving an inertia ratio $(I+MR^2/I)$ of greater than 2.0 wherein I is the moment of inertia, M is the total weight of the golf club and R is the effective length of the golfer's arms comprising the steps of:

(a) establishing a first predetermined weight for the head of each golf club;

(b) establishing a first predetermined weight for the shaft of each golf club;

(c) establishing a predetermined weight for the grip of each golf club;

(d) reducing the first predetermined weight for the head of each golf club by a second predetermined weight;

(e) calculating an additional weight for each golf club in the set of golf clubs and positioning the additional weight adjacent the gripping area wherein the mass of the additional weight is calculated in accordance with the first predetermined weight for the head of each club less the second predetermined weight so as to achieve an inertia ratio of the golf club of greater than 2.0 wherein the center of gravity of the additional weight is between 0 to 4 inches below the normal central position of the golfer's hands on the gripping area such that (1) the moment ($M_1$) about the wrist-cock axis during movement of the golf club during the downswing of the golf club is less than $24.5\times10^3$ gm cm and (2) the moment of inertia ($M_2$) about the wrist-cock axis during movement of the golf club during the downswing of the golf club between uncocking of the golfer's wrists and the striking of a ball is less than $1.9\times10^6$ gm cms$^2$.

20. A method of designing a set of golf clubs wherein each golf club in the set has a different length and includes a shaft having a butt end and a head end, and a distinct grip disposed on said shaft and extending from said butt end of the shaft toward said head end and defining a normal gripping area for gripping the club by a golfer and including a normal central position located about 4 inches below the butt end of the shaft and a head affixed to the head end of the shaft and wherein each club is weighted such that during the downswing of a club by the golfer a moment ($M_1$) and moment of inertia ($M_2$) about a wrist-cock axis is controlled wherein the wrist-cock axis is an axis perpendicular to the longitudinal axis of the shaft about which the golfer breaks his wrists during the downswing of the club thereby achieving an inertia ratio $(I+MR^2/I)$ of greater than 2.0 wherein I is the moment of inertia, M is the total weight of the golf club and R is the effective length of the golfer's arms comprising the steps of:

(a) establishing a first predetermined weight for the head of each golf club;

(b) establishing a first predetermined weight for the shaft of each golf club;

(c) establishing a predetermined weight for the grip of each golf club;

(d) reducing the first predetermined weight for the head of each golf club by a second predetermined weight;

(e) calculating an additional weight for each golf club in the set of golf clubs and positioning the additional weight adjacent the gripping area wherein the mass of the additional weight is calculated in accordance with the first predetermined weight for the head of each club less the second predetermined weight so as to achieve an inertia ratio of the golf club of greater than 2.0 wherein the center of gravity of the additional weight is between 0 to 4 inches below the normal central position of the golfer's hands on the gripping area such that (1) the moment ($M_1$) about the wrist-cock axis during movement of the golf club during the downswing of the golf club is less than $23.5\times10^3$ gm cm and (2) the moment of inertia ($M_2$) about the wrist-cock axis during movement of the golf club during the downswing of the golf club between uncocking of the golfer's wrists and the striking of a ball is less than $1.8\times10^6$ gm cms$^2$.

21. A method of designing a set of golf clubs wherein each golf club in the set has a different length and includes a shaft having a butt end and a head end, and a distinct grip disposed on said shaft and extending from said butt end of the shaft toward said head end and defining a normal gripping area for gripping the club by a golfer and including a normal central position located about 4 inches below the butt end of the shaft and a head affixed to the head end of the shaft and wherein each club is weighted such that during the downswing of a club by the golfer a moment ($M_1$) and moment of inertia ($M_2$) about a wrist-cock axis is controlled wherein the wrist-cock axis is an axis perpendicular to the longitudinal axis of the shaft about which the golfer breaks his wrists during the downswing of the club thereby achieving an inertia ratio $(I+MR^2/I)$ of greater than 2.0 wherein I is the moment of inertia, M is the total weight of the golf club and R is the effective length of the golfer's arms comprising the steps of:

(a) establishing a first predetermined weight for the head of each golf club;

(b) establishing a first predetermined weight for the shaft of each golf club;

(c) establishing a predetermined weight for the grip of each golf club;

(d) reducing the first predetermined weight for the head of each golf club by a second predetermined weight;

(e) calculating an additional weight for each golf club in the set of golf clubs and positioning the additional weight adjacent the gripping area wherein the mass of the additional weight is calculated in accordance with the first predetermined weight for the head of each club less the second predetermined weight so as to achieve an inertia ratio of the golf club of greater than 2.0 wherein the center of gravity of the additional weight between 0 to 4 inches below the normal central position of the golfer's hands on the gripping area such that (1) the moment ($M_1$) about the wrist-cock axis during movement of the golf club during the downswing of the golf club is less than $23.0 \times 10^3$ gm cm and (2) the moment of inertia ($M_2$) about the wrist-cock axis during movement of the golf club during the downswing of the golf club between uncocking of the golfer's wrists and the striking of a ball is less than $1.7 \times 10^6$ gm cms$^2$.

* * * * *